US005746065A

United States Patent [19]

Patel et al.

[11] Patent Number: 5,746,065

[45] Date of Patent: May 5, 1998

[54] ACCUMULATOR DEFLECTOR CONNECTION AND METHOD

[75] Inventors: Chhotu Patel, Farmington Hills; Larry M. Lafer, Plymouth; Steven M. Tossey, Waterford, all of Mich.

[73] Assignee: Automotive Fluid Systems, Inc., Troy, Mich.

[21] Appl. No.: 701,174

[22] Filed: Aug. 21, 1996

[51] Int. Cl.[6] ..... F25B 43/00

[52] U.S. Cl. ..... 62/503; 29/890.06; 55/413; 55/465; 55/466

[58] Field of Search ..... 62/503; 55/413, 55/465, 466; 29/428, 890.06

[56] References Cited

U.S. PATENT DOCUMENTS

| | | | |
|---|---|---|---|
| 3,754,409 | 8/1973 | Wreen, Jr. et al. | 62/503 |
| 4,111,005 | 9/1978 | Livesay | 62/503 |
| 4,627,247 | 12/1986 | Morse | 62/503 |
| 4,768,355 | 9/1988 | Breuhan et al. | 62/503 |
| 4,800,737 | 1/1989 | Smith et al. | 62/503 |
| 5,075,967 | 12/1991 | Bottum | 62/503 |
| 5,184,479 | 2/1993 | Koberstein et al. | 62/503 |
| 5,184,480 | 2/1993 | Kolpacke | 62/503 |
| 5,245,842 | 9/1993 | Searfoss et al. | 62/474 |
| 5,375,327 | 12/1994 | Searfoss et al. | 29/890.06 |
| 5,479,790 | 1/1996 | Bottum, Jr. et al. | 62/503 |
| 5,507,159 | 4/1996 | Cooksey | 62/503 |

*Primary Examiner*—William E. Tapolcal
*Attorney, Agent, or Firm*—Vanophem Meehan & Vanophem, P.C.

[57] ABSTRACT

An accumulator deflector connection is used in an accumulator including a deep drawn can connected to a puck having an inlet passage and an outlet passage. The outlet passage includes a counterbore having a cylindrical bushing received therein, the deflector has a cylindrical extension received within the passage of the cylindrical bushing and the outlet end of the outlet tube is received within the passage of the cylindrical extension of the deflector and the cylindrical bushing is crimped to create a mechanical lock. In an alternate embodiment, the outlet end of the outlet tube includes knurling thereon and is located in the passage of the cylindrical extension of the thermoplastic deflector and the thermoplastic deflector is melted into the knurling during the welding of the can to the puck. In a further alternate embodiment, the outlet end of the outlet passage includes a radial channel located at the crimp of the connection to create a stronger mechanical lock between the cylindrical bushing, the deflector and the outlet tube.

9 Claims, 2 Drawing Sheets

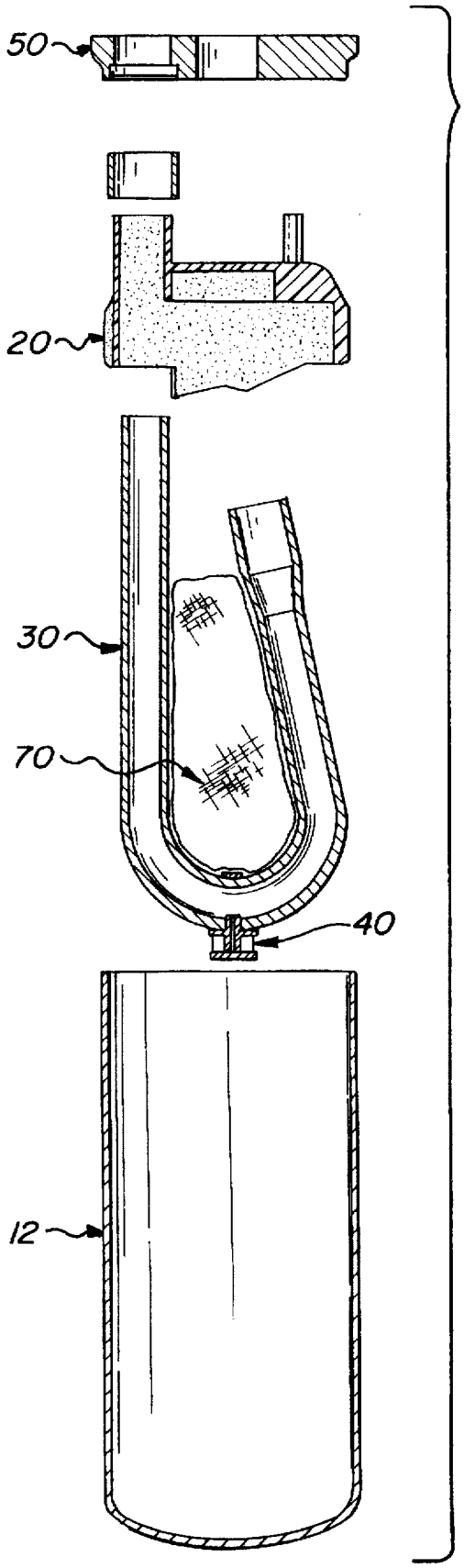
FIG-2
FIG-3
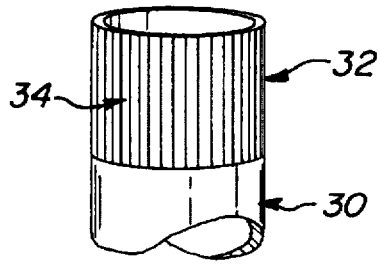
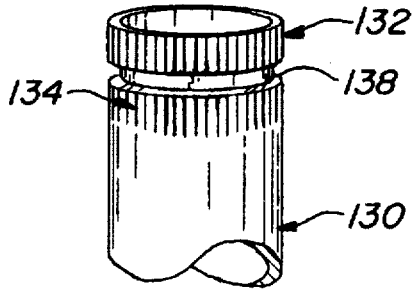
FIG-4
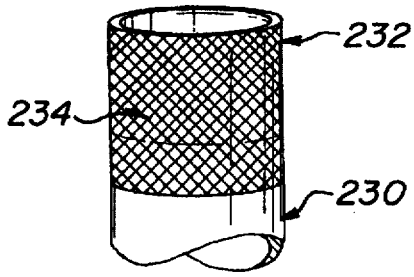
FIG-5

ACCUMULATOR DEFLECTOR CONNECTION AND METHOD

BACKGROUND OF THE INVENTION

1. Field of the Invention

The present invention generally relates to air-conditioning systems. More particularly the present invention relates to an accumulator dehydrator and a method of manufacturing an accumulator dehydrator for use in an automobile's air-conditioning system, the accumulator including a connection for the deflector, or baffle, within the accumulator can and outlet tube.

2. Description of the Prior Art

Accumulator dehydrators (or accumulators) for vehicular air conditioning systems function to change liquid refrigerant to a gas after separating the liquid refrigerant from the gaseous refrigerant. One type of vehicle air-conditioning system includes a compressor, a condenser, an evaporator and an accumulator dehydrator. The accumulator receives liquid and gaseous refrigerant from the evaporator through an inlet tube and returns only gaseous or vaporous refrigerant to the compressor by means of an outlet tube.

Most accumulator assemblies incorporate a baffle plate or deflector situated within the accumulator can, usually located near the top of the accumulator, to help prevent liquid refrigerant from reaching the inlet end of the outlet tube. Typically, the refrigerant fluid flows onto the deflector and is dispersed down the sides of the accumulator housing. An outlet tube, usually a "J"-shaped tube, passes through the deflector and through the top of the accumulator to return vapor to the compressor.

One example of the prior art type deflector is U.S. Pat. No. 4,474,035, to Amin et al., the specification of which is incorporated herein by reference, which discloses the common practice to have the deflector assembled to the inside of the accumulator can by means of a press or interference fit. The deflector usually has protrusions that contact the inside diameter of the accumulator housing to result in an interference fit to hold the deflector in place. However, these types of deflectors are difficult to assemble and are not compatible with all types of material, in particular, aluminum, as more fully described below.

U.S. Pat. No. 4,768,355, to Breuhan et al., discloses a cartridge positioned within the accumulator housing for processing the flow of refrigerant fluid. The cartridge casing includes retention and locating members extending from the cartridge and contacting embossments located on the inner surface of the accumulator housing. Breuhan et al. disclose an accumulator utilizing a straight outlet tube having the cartridge connected to the outlet tube. The cartridge has a passage vertically therethrough in which an outlet tube is received. Similar to the '355 reference is U.S. Pat. No. 4,800,737, to Smith et al. The '737 reference is an improvement of the '355 reference including an evaporative pressure regulator. Both of these references disclose the coupling of a refrigerant processing cartridge to the outlet tube of an accumulator. However, the accumulator is very bulky, expensive and difficult to manufacture. Furthermore, the cartridge of the present invention is not reliable in service.

U.S. Pat. No. 5,184,479, to Koberstein, et al., discloses an accumulator with an outlet tube within the housing which exits at the bottom of the housing, and a deflector, mounted at the top of the housing, to temporarily impede the flow of refrigerant passing between the inlet tube and the outlet tube. The outlet tube shield is welded or brazed to the inlet tube between the housing and the free end of the outlet tube.

These known accumulator assemblies are usually made of metal, and in particular steel. While the above described design has worked well with steel, when applying the interference fit design of prior art deflectors to an accumulator made of aluminum, difficulties result from problems relating to tolerance stack-up, the hardness of the materials used, and varying coefficients of friction, if different materials are used for different parts, as is sometimes desired.

U.S. Pat. No. 4,111,005, awarded to Livesay, discloses a press-on baffle that is made entirely of plastic. The baffle is secured by three, spaced apart upwardly tapered webs, each of which supports a vertically extending arcuate rib portion providing a press fit with the standpipe or outlet tube. However, this design is inflexible since there are no options with respect to the design of the plastic baffle. The baffle must be designed around a specific standpipe diameter to successfully retain the standpipe. The costs associated with a large die for intricate plastic molding are very high. In addition, the plastic baffle surface is not as durable as aluminum or steel in an area which must withstand refrigerant fluid pulsing in from the compressor at relatively high pressures and cycle rates.

One solution, as set forth in the Amin et al. reference, is to tack weld the deflector to the outlet tube prior to inserting the combination into the accumulator housing. However, if the weld becomes weak during assembly, it can fail during use. Thus, a mechanical lock of the deflector to the outlet tube within the housing may be used as a potential solution as well. However, additional assembly and process steps may add significant unnecessary complexity and cost to the accumulator. Thus, there is still a need to develop an accumulator having an outlet tube and a deflector covering the inlet end of the outlet tube to prevent liquid refrigerant from entering the outlet tube as well as preventing blow by, which is inexpensive, highly reliable and has a minimum of parts to help minimize costs of manufacture and assembly.

Based upon the above, it should be appreciated that there is still a need to provide an accumulator having a deflector which is inexpensive, easy to manufacture and install, and will withstand the relatively harsh environment inside an accumulator dehydrator used in an automotive air-conditioning system.

SUMMARY OF THE INVENTION

An accumulator for use in a vehicle air-conditioning system includes a housing including a can and an end, an inlet tube connected and communicating with the housing, an outlet tube connected to the housing, and a deflector connected to the outlet tube. The accumulator housing has an inlet opening, to which the inlet tube is connected and an outlet opening to which the outlet tube and deflector are connected.

The inlet tube is connected to the top of the accumulator housing for introducing fluid refrigerant into the accumulator. The deflector, or baffle, made preferably of thermoplastic material such as nylon, is located below the inlet opening and deflects incoming refrigerant fluid to the sides of the accumulator housing. The deflector prevents liquid refrigerant from being sent to the compressor of the air-conditioning system by means of the inlet end of the outlet tube which is located below the deflector.

The deflector connection includes a cylindrical bushing located in the outlet passage in the end of the housing, a cylindrical extension of the deflector located within the cylindrical bushing, and the outlet end of the outlet tube located within the cylindrical extension of the deflector.

Furthermore, the deflector connection of the present invention also includes crimping the cylindrical bushing once the deflector and outlet end of the outlet tube are positioned therein and it includes the addition of knurling located on the outlet end of the outlet tube.

Furthermore, in the preferred embodiment, the deflector connection of the present invention further includes the thermoplastic cylindrical extension of the deflector being molded to the knurling on the outlet end of the outlet tube to prevent the outlet tube from rotating. Finally, the molding of the thermoplastic to the knurling prevents blow by of liquid refrigerant fluid past the deflector connection.

Accordingly, it is an object of the present invention to provide an accumulator having a deflector connected to the outlet tube.

It is an object of the present invention to improve the design of an accumulator deflector connection and eliminate the problems associated with prior art connection methods used for connecting the deflector within the housing.

It is an object of the present invention to provide an accumulator having a deflector connection wherein the deflector, outlet tube, bushing or connector tube, puck and desiccant are all connected to the puck of the accumulator and inserted in the can in a single step, then the can is welded to the puck.

It is yet a further object of the present invention to provide a seal between the deflector and the outlet tube improving its performance.

It is a further object of the present invention to provide an accumulator which overcomes the problems of the prior art, has a lower overall cost and is easier to manufacture.

BRIEF DESCRIPTION OF THE DRAWINGS

FIG. 2 shows an expanded view of the accumulator of FIG. 1, detailing the assembly of the parts of the accumulator deflector connection according to the present invention.

FIG. 3 is a perspective view of an outlet end of an outlet tube, detailing part of the deflector connection according to the preferred embodiment of the present invention.

FIG. 4 is a perspective view of an outlet end of an outlet tube, detailing part of the deflector connection according to a first alternative embodiment of the present invention.

FIG. 5 is a perspective view of an outlet end of an outlet tube, detailing part of the deflector connection according to a second alternative embodiment of the present invention.

DETAILED DESCRIPTION OF THE PREFERRED EMBODIMENT

Figure 1:
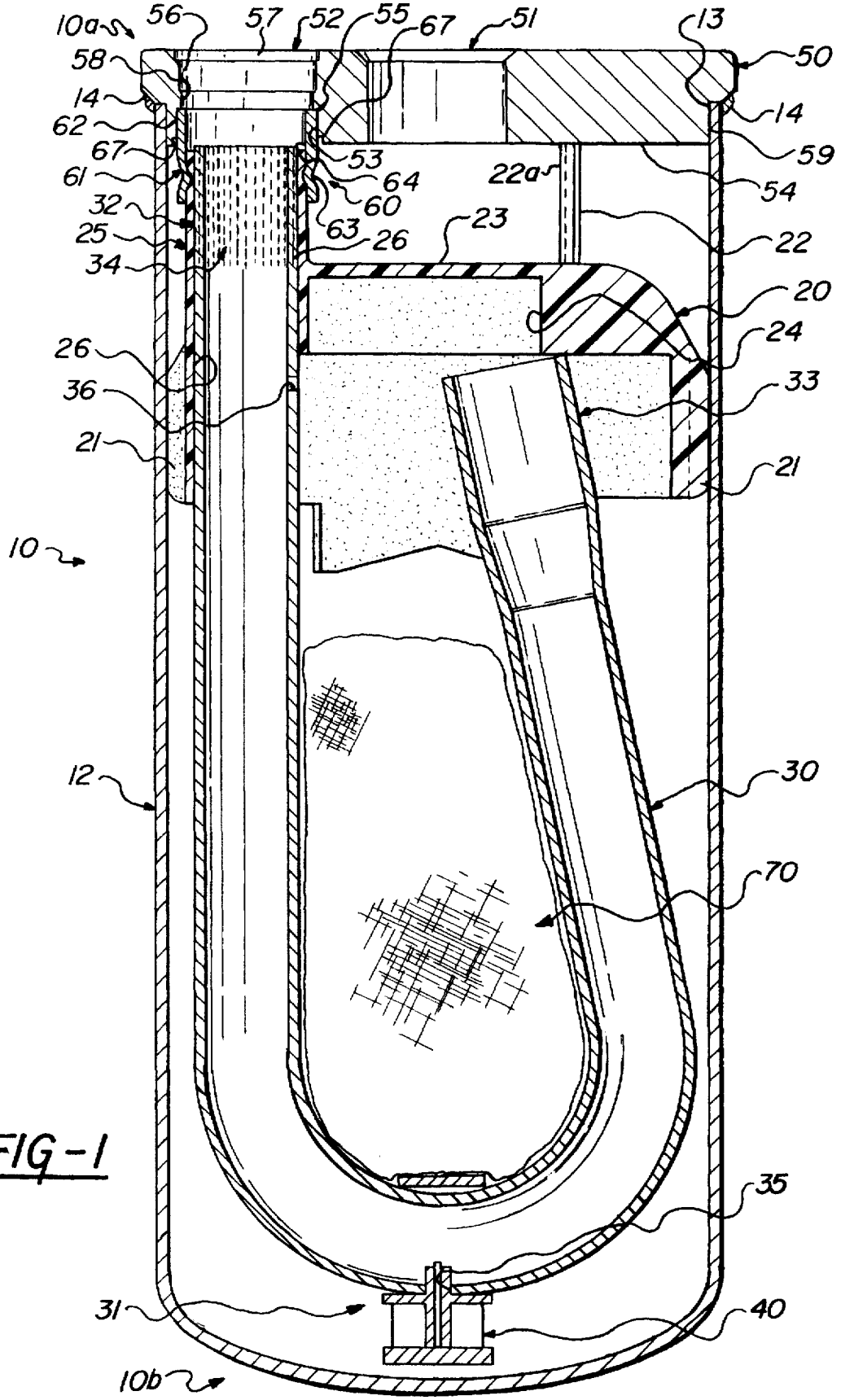
FIG. 1 is a cross-sectional view of an accumulator having a deflector connection according to the present invention.

Referring generally to FIGS. 1 through 5, and in particular to FIG. 1 and FIG. 2, there is shown an accumulator, generally indicated as 10, according to the present invention for use in an automotive air-conditioning system. The accumulator 10 is designed to be connected into an air-conditioning system including a compressor (not shown), a condenser (not shown) and an evaporator (not shown). The accumulator 10 has a first end 10*a*, a second end 10*b*, a housing composed of a can 12, a baffle or deflector 20, an outlet tube 30, an oil filter 40, a puck 50, a deflector connection 60 and a desiccant bag 70.

The can 12 is preferably made from a light alloy material, such as aluminum, of a quality and grade appropriate for accumulators. The can 12 is manufactured using a deep draw process resulting in an open end 13. The second end 10*b* of the accumulator 10 is formed in the can 12 during the deep draw process.

The first end 10*a* of the accumulator 10 is formed by the puck 50 of the present invention. The puck 50 can be manufactured using any known appropriate process, however, the puck is preferably manufactured using a machining process. The puck includes an inlet passage 51 and an outlet passage 52 which have an external inlet hose (not shown) and an external outlet hose (not shown) connected thereto, respectively, for connection to the air-conditioning system of the automobile.

The outlet passage 52 includes a first counterbore 53 located on an inner side 54 of the puck 50 creating a stop or land 55, as more fully described below. The outlet passage 52 further includes a second counterbore 56 and a third counterbore 57 that are used by the external outlet hose that is connected to the puck 50. The machining of the first, second and third counterbores 53, 56 and 57, respectively, results in a hole 58 in the middle of the outlet passage 52.

The puck 50 includes a reduced diameter portion 59 which is inserted in the open end 13 of the can 12. The puck 50 is connected to the can 12 using a M.I.G. welding process or other appropriate process for welding the can 12 to the puck 50 as is well known in the art. The welding process results in a weld 14 between the can 12 and the puck 50.

The deflector 20 of the present invention has a general cup shape, upside down in FIGS. 1 and 2, and is preferably manufactured from a thermoplastic material such as nylon. However, it is possible to use a metal or alloy material. The deflector is located within the can 12 and includes radially spaced tab extensions 21 for maintaining the position of the deflector 20 within the housing of the accumulator 10.

The deflector 20 further includes a vertical extension 22 extending from an upper surface 23 of the deflector 20. The vertical extension 22 has an end 22*a* which abuts the inner surface 54 of the puck 50 to help keep the deflector 20 in position and prevent vibration and movement of the deflector 20 during operation. The deflector 20 of the preferred embodiment includes a tab 24 which coacts with an inlet end 33 of the outlet tube to also help keep the deflector 20 in place during operation. The tab 24 preferably has a relatively narrow width, which would be into the page in FIG. 1 and FIG. 2, as compared to the inlet end 33 of the outlet tube 30 to prevent blocking flow of the gaseous refrigerant fluid in the housing of the accumulator 10.

The deflector 20 also includes a cylindrical extension 25 which is preferably integral and unitary with the deflector 20, the tabs 21, vertical extension 22, upper surface 23, and tab 24. It is also possible to have multiple vertical extensions 22 balanced and spaced from the cylindrical extension 25 of the deflector 20. The cylindrical extension 25 has a passage 26 which has an outlet end 32 of the outlet tube 30 located therein. The cylindrical extension 25 is located within and constitutes part of the connection 60 as described below.

The outlet tube 30 of the present invention is formed as a "J" tube having a bight portion 31. The oil filter 40 of the accumulator 10 is located in a hole 35 located in the bottom of the bight portion 31 of the outlet tube 30 for entraining oil in the gaseous refrigerant fluid sent to the compressor. The outlet tube 30 further includes an anti-siphon hole 36 as is well known in the art.

The outlet tube 30 includes knurling 34 which consists of lines formed in the outlet end 32 of the outlet tube 30. The knurling 34 is formed using any known process to create the lines altering the surface of the outlet end 32 of the outlet tube 30 sufficient to create areas into which the thermoplastic cylindrical extension 25 of the deflector 20 may flow when heated as described below.

The knurling 34 of the preferred embodiment of the present invention is detailed in FIG. 3. In a first alternate embodiment shown in FIG. 4, a tube 130 includes an end 132 and knurling 134. However, the tube 130 of the present embodiment differs in that a radial groove 138 is formed in the end 132 within the knurling 134. The radial groove 138 functions with the connection 60 as more fully described below. The radial groove 138 may be formed in the end 132 using any known process, however, it is preferable to use a rolling process for forming the radial groove 138.

In a second alternate embodiment shown in FIG. 5, the tube 230 has and end 232 having knurling 234 which consists of crisscrossing lines. In this embodiment, when the thermoplastic material of the deflector 20 is caused to melt into the lines of the knurling 234, additional mechanical locking is achieved in both horizontal and vertical directions.

The desiccant bag 70 is connected to the outlet tube 30 in any known manner. Preferably, the desiccant bag 70 is connected within and near the bight portion 31 of the outlet tube 30 such that the desiccant bag 70 is carried by the outlet tube 30 and can be inserted within the can 12 of the housing of the accumulator 10 during manufacture. The oil filter 40 is connected to the bight portion 31 of the outlet tube 30 to siphon oil from the end **10*b* of the accumulator 10** for lubrication of the compressor, as is well known in the art.

The connection 60 of the preferred embodiment includes a bushing 61, a first end 62 thereof, that has a passage 64 located in the first counterbore 53 of the outlet passage 52, the cylindrical extension 25 of the deflector 20 located in the passage 64 of the bushing 61 and a reduced diameter or crimp 63 of the bushing 61. Once the bushing 61 has been mechanically locked to the puck 50, as described below, the outlet tube 30 and the deflector 20 are properly positioned and the crimp 63 is made. The crimp 63 is made using any known crimping device for crimping a tube of the respective material, i.e. such as an aluminum tube crimper.

The bushing 61 is preferably inserted in the first counterbore 53 such that there is a low mechanical press fit such that the bushing 61 will not become removed from the first counterbore 53. Once inserted, the connection between the puck 50 and the bushing 61 preferably is made more secure by spiking the puck around the outer periphery of the bushing 61 resulting in a spike mark 67 around the circumference of the bushing 61. The spiking of the bushing is preferably made using a similarly shaped tool having a leading edge designed to spike the material of the puck into the outer periphery of the bushing 61 during manufacture of the accumulator 10.

Thus, once the connection 60 is made, all of the sub parts of the accumulator 10 are connected to the puck 50, such that the only remaining step is to insert the outlet tube 30, oil filter 40, connection 60 and desiccant bag 70 into the can 12 and then weld the puck 50 into the open end 13 of the can 12 such that the reduced diameter portion 59 of the puck is located within the can 12. Next the weld 14 can be made as described above, which creates a buildup of heat in the connection 60. The welding process can be controlled to create an appropriate amount of heat buildup in the connection 60 such that the thermoplastic material of the deflector 20 is allowed to soften sufficiently to conform to the lines of the knurling 34 on the outlet end 32 of the outlet tube 30.

While the invention has been described in terms of a preferred embodiment with reference to several alternate embodiments, it should be apparent to one skilled in the art that variants and substitutes to the elements of the above described invention can be adopted by one skilled in the art without departing from the present invention. Accordingly, the scope of the present invention is to be limited only by the following claims.

What is claimed is:

1. An accumulator deflector connection for an accumulator of an air-conditioning system said accumulator having a housing and a desiccant material said accumulator deflector connection comprising:

an outlet passage located in said accumulator;

a bushing having a passage and a first end, said first end of said bushing located in said outlet passage of said accumulator;

an outlet tube having an outlet end, said outlet end of said outlet tube has knurling located thereon and said bushing has a crimped, reduced diameter portion located adjacent said knurling; and a thermoplastic deflector having a cylindrical extension having a passage and a locating extension member extending in a predefined direction and spaced from said cylindrical extension, said cylindrical extension inserted in said bushing, said passage of said cylindrical extension communicating with said passage of said bushing and said outlet passage.

2. An accumulator deflector connection as set forth in claim 1 wherein said housing of said accumulator comprises a deep drawn can having an open end and a puck connected to said open end of said deep drawn can, said outlet passage located in said puck.

3. An accumulator deflector connection as set forth in claim 2 wherein said puck comprises an inner side, a first counterbore in said inner side of said puck, a land defined by said first counterbore, said first end of said bushing located in said first counterbore of said puck and abutting said land.

4. An accumulator deflector connection as set forth in claim 1, further comprising a desiccant bag containing said desiccant material, said desiccant bag connected to said outlet tube at a point below said deflector.

5. An accumulator deflector connection as set forth in claim 1 wherein said knurling comprises a radial spaced plurality of depression lines located about said outlet end of said outlet tube.

6. An accumulator deflector connection as set forth in claim 1 wherein said outlet tube comprises a radial groove having said knurling located proximate said radial groove, said crimped, reduced diameter portion of said bushing located at said radial groove of said outlet end of said outlet tube.

7. A method of manufacturing an accumulator having a deflector connection, said method comprising the steps of:

manufacturing a puck having an inlet passage and an outlet passage, said puck having an inner side;

manufacturing a deep drawn can constituting a portion of a housing of said accumulator, said can having an open end;

connecting a cylindrical bushing having a passage in said outlet passage on said inner side of said puck;

assembling a cylindrical extension of a thermoplastic deflector in said passage of said cylindrical bushing;

creating knurling on an outlet end of an outlet tube;

assembling said outlet end in said passage of said cylindrical extension of said deflector;

connecting a desiccant to said outlet tube;

connecting an oil filter to said outlet tube;

crimping said bushing at a point including said bushing, said cylindrical extension and said knurling of said outlet end of said outlet tube; and welding said puck to said open end of said can to heat said bushing and said thermoplastic deflector to cause said thermoplastic deflector to form to said knurling of said outlet end of said outlet tube;

whereby said accumulator deflector connection is formed and said thermoplastic deflector and outlet tube are mechanically locked to said puck.

8. A method of manufacturing an accumulator deflector connection as set forth in claim 7 further comprising the steps of:

forming a radial groove in said outlet end of said outlet tube; and locating said crimping at said radial groove in said outlet end.

9. A method of manufacturing an accumulator deflector connection as set forth in claim 7 further comprising the step of staking said bushing in said outlet passage of said puck.

* * * * *

UNITED STATES PATENT AND TRADEMARK OFFICE

CERTIFICATE OF CORRECTION

PATENT NO. : 5,746,065
DATED : May 5, 1998
INVENTOR(S) : Patel et al.

It is certified that error appears in the above-identified patent and that said Letters Patent is hereby corrected as shown below:

Column 1, line 16, kindly delete "air conditioning" and insert ---- air-conditioning ----.

Column 5, line 15, kindly delete "and" and insert ---- an ----; line 31, after "a bushing 61," kindly insert ---- at ----.

Column 6, line 9, after "system" kindly insert a comma ---- , ----; line 10, after "material", kindly insert a comma ---- , ----; line 43, kindly delete "radial" and insert ---- radially ----.

Signed and Sealed this
Sixth Day of April, 1999

*Attest:*

*Attesting Officer*

Q. TODD DICKINSON

*Acting Commissioner of Patents and Trademarks*